US010467967B2

(12) United States Patent
Yonemaru et al.

(10) Patent No.: US 10,467,967 B2
(45) Date of Patent: Nov. 5, 2019

(54) DRIVING CIRCUIT OF LED FOR LIQUID CRYSTAL BACKLIGHT, CONTROL CIRCUIT THEREOF, AND ELECTRONIC DEVICE

(71) Applicant: ROHM CO., LTD., Ukyo-Ku, Kyoto (JP)

(72) Inventors: Masao Yonemaru, Kyoto (JP); Kenichi Fukumoto, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 127 days.

(21) Appl. No.: 15/429,686

(22) Filed: Feb. 10, 2017

(65) Prior Publication Data

US 2017/0236472 A1 Aug. 17, 2017

(30) Foreign Application Priority Data

Feb. 12, 2016 (JP) ..... 2016-024616

(51) Int. Cl.
*G09G 3/34* (2006.01)
*H05B 33/08* (2006.01)

(52) U.S. Cl.
CPC ..... *G09G 3/342* (2013.01); *H05B 33/0815* (2013.01); *G09G 2320/064* (2013.01); *G09G 2320/0633* (2013.01)

(58) Field of Classification Search
CPC ..... H09G 3/342; H05B 33/0815; G09G 2320/064
USPC ..... 345/690
See application file for complete search history.

(56) References Cited

U.S. PATENT DOCUMENTS

2002/0195954 A1* 12/2002 Kim ..... H05B 41/3922 315/149
2003/0034765 A1* 2/2003 Yang ..... H02M 1/40 323/284
2004/0145560 A1* 7/2004 Kim ..... G09G 3/3406 345/102
2010/0164579 A1* 7/2010 Acatrinei ..... H02M 1/4208 327/172
2014/0192563 A1* 7/2014 Lin ..... H02M 3/33523 363/21.13

FOREIGN PATENT DOCUMENTS

JP 2003153529 A 5/2003
JP 2004047538 A 2/2004

* cited by examiner

*Primary Examiner* — Mark W Regn
(74) *Attorney, Agent, or Firm* — Cantor Colburn LLP

(57) ABSTRACT

A control circuit of a driving circuit of a backlight LED is provided. The driving circuit includes a DC/DC converter that supplies a driving current to the backlight LED. The control circuit includes a pulse signal generating circuit configured to switch between a quasi-resonant mode and a continuous current mode to generate a pulse signal based on a selected mode and a driver configured to drive the DC/DC converter based on the pulse signal.

20 Claims, 9 Drawing Sheets

DRIVING CIRCUIT OF LED FOR LIQUID CRYSTAL BACKLIGHT, CONTROL CIRCUIT THEREOF, AND ELECTRONIC DEVICE

CROSS-REFERENCE TO RELATED APPLICATION

This application is based upon and claims the benefit of priority from Japanese Patent Application No. 2016-024616, filed on Feb. 12, 2016, the entire contents of which are incorporated herein by reference.

TECHNICAL FIELD

The present disclosure relates to a technique of lighting an LED for a liquid crystal backlight.

BACKGROUND

Recently, a light emitting device including a light emitting diode (LED) has been used as a backlight of a liquid crystal panel or a lighting device.

A driving circuit of an LED includes a DC/DC converter and a control circuit thereof. The control circuit controls a switching element of the DC/DC converter so that a current flowing through an LED bar (also referred to as an LED string) configured by connecting a plurality of LEDs in series approaches a target value. The brightness of the LEDs may be controlled by changing the target value (analog dimming).

In addition to this analog dimming, pulse width modulation (PWM) dimming may be used together in some cases. In the PWM dimming, a turn-on period during which a driving current is supplied to the LEDs and a turn-off period during which the driving current is interrupted are alternately repeated at constant intervals to change a time ratio of the turn-on period and the turn-off period, thereby changing the brightness of the LEDs.

In the DC/DC converter, there are various driving schemes. Conventionally, the designer of a liquid crystal display device has decided a driving scheme of the DC/DC converter and purchased a control circuit that supports the driving scheme.

However, a wide dynamic range is required for the backlight of the liquid crystal panel. In particular, in a driving circuit used in a display device that supports switching between 2D display and 3D display, it is necessary in a 3D display to make a driving current flow several times as much as a 2D display. That is, in the DC/DC converter of the driving circuit of the backlight LEDs, it is necessary to change its output current within the range of several times by the analog dimming.

In the DC/DC converter, there exist various characteristics such as power consumption (efficiency), heat generation, EMI characteristics, acoustic noise and the like. When the backlight LEDs are fixedly controlled by a single driving scheme as in the related art, there is a problem in that some characteristics are good, while others deteriorate, depending on a range of an output current.

SUMMARY

The present disclosure provides some embodiments of a driving circuit of an LED for a liquid crystal backlight, capable of obtaining good characteristics within an extensive output current range.

According to one embodiment of the present disclosure, there is provided a control circuit of a driving circuit of a backlight LED. The driving circuit includes a DC/DC converter that supplies a driving current to the backlight LED. The control circuit includes: a pulse signal generating circuit configured to switch between a quasi-resonant mode and a continuous current mode to generate a pulse signal based on a selected mode; and a driver configured to drive the DC/DC converter based on the pulse signal.

According to the present embodiment, by switching between a quasi-resonant (QR) mode and a continuous current mode (CCM) depending on an operational state of a backlight, it is possible to suppress heat generation of the switching transistor and to improve the EMI characteristics in the former, and to suppress a peak coil current and to suppress driving current ripples in the latter.

The pulse signal generating circuit may include: a first pulse modulator of the quasi-resonant mode configured to generate a first pulse signal and a second pulse modulator of the continuous current mode configured to generate a second pulse signal.

The continuous current mode may he a peak detection or OFF time fixed mode. In this case, a comparator for peak detection may share with a comparator in the quasi-resonant mode. Alternatively, the continuous current mode may he a bottom detection or ON time fixed mode. The continuous current mode may be a frequency fixed PWM mode.

The control circuit may further include an interface circuit configured to receive a mode selection signal. The pulse signal generating circuit may be configured to select a mode corresponding to the mode selection signal.

The control circuit may be configured to receive an analog dimming signal indicative of a current amount of the backlight LED. The pulse signal generating circuit may be configured to select a mode based on the analog dimming signal.

The pulse signal generating circuit may further include a selector configured to select one of the first pulse signal and the second pulse signal and output a selected pulse signal to the driver.

The DC/DC converter may include: a switching transistor; a coil; a rectifying device; and a first resistor disposed on a path of a current flowing through the switching transistor during an ON period of the switching transistor.

The pulse signal generating circuit may further include: a first comparator configured to generate a first signal to be asserted when a current sensing signal indicative of a voltage drop of the first resistor reaches a first threshold value; and a zero-cross detection circuit configured to generate a second signal to be asserted when a current flowing through the coil becomes zero during an OFF period of the switching transistor. The first pulse modulator may be configured to cause the first pulse signal to transition to an OFF level in response to the first signal and to cause the first pulse signal to transition to an ON level in response to the second signal.

The zero-cross detection circuit may include a second comparator configured to compare a voltage input to a zero-cross detection terminal with a predetermined second threshold value to generate the second signal based on the comparison result.

The DC/DC converter may further include: a capacitor and a second resistor installed in series between a connection point of the switching transistor and the coil and ground. A voltage of the second resistor may he input to the zero-cross detection terminal.

The DC/DC converter may further include: an auxiliary coil coupled to the coil. A voltage of the auxiliary coil may be input to the zero-cross detection terminal.

The pulse signal generating circuit further includes: an OFF time generating circuit configured to generate a third signal to be asserted when a predetermined OFF time has elapsed since the second pulse signal has been transitioned to an OFF level. The second pulse modulator may be configured to cause the second pulse signal to transition to an OFF level when the first signal is asserted and to cause the second pulse signal to transition to an ON level when the third signal is asserted.

The pulse signal generating circuit may further include: an error amplifier configured to amplify an error between the current sing signal indicative of a voltage drop of the first resistor and a predetermined reference voltage to generate, fourth signal. The second pulse modulator may be configured to generate the second pulse signal based on a result of comparison between the fourth signal and a periodic signal having a predetermined frequency.

The control circuit of some embodiments may be integrated on a single semiconductor substrate. The term "integrated" may include a case where all the components of a circuit are formed on a semiconductor substrate or a case where major components of a circuit are integrated, and some resistors, capacitors, or the like ay be installed outside the semiconductor substrate in order to adjust circuit constants.

According to another embodiment of the present disclosure, there is provided a driving circuit. The driving circuit includes: a DC/DC converter configured to supply a driving current to a backlight LED; and any one of the control circuits as described above, configured to control the DC/DC converter.

According to still another embodiment of the present disclosure, there is provided an electronic device. The electronic device includes; a liquid crystal panel; a backlight including an LED and configured to irradiate light to the liquid crystal panel from a rear side; and the aforementioned driving circuits configured to drive the LED.

The DC/DC converter may be a buck converter. An input voltage is applied to one end of the LED and an output voltage of the DC/DC converter may be applied to the other end of the DC/DC converter.

The DC/DC converter may be a flyback converter. The DC/DC converter may be a forward converter.

Further, arbitrarily combining the foregoing components or substituting the components or expressions of the present disclosure with one another among a method, an apparatus, and a system is also effective as an embodiment of the present disclosure.

DETAILED DESCRIPTION

Figure 1:
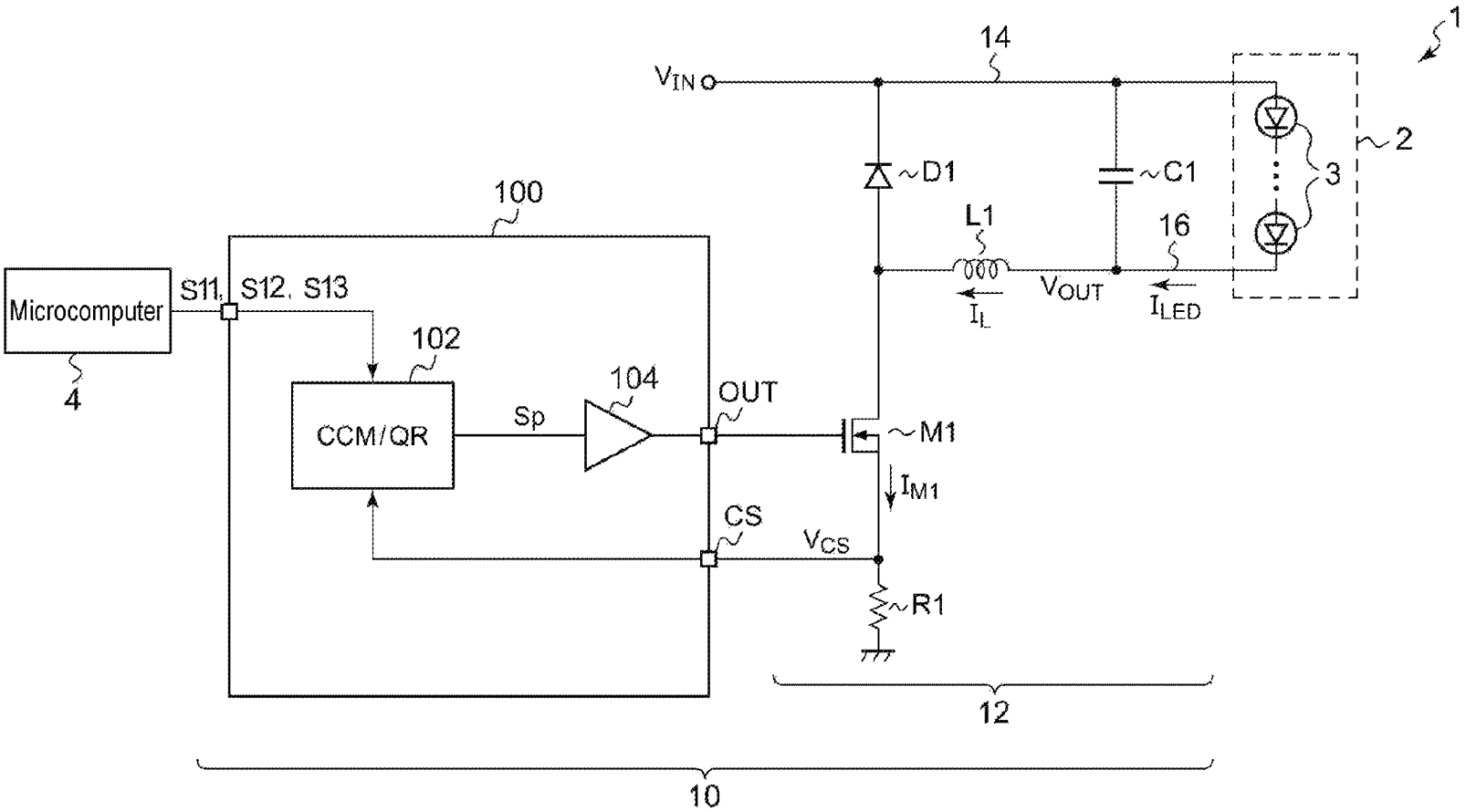
FIG. 1 is a circuit diagram of a backlight device including a control circuit according to an embodiment of the present disclosure.

Embodiments of the present disclosure will be now described in detail with reference to the drawings. Like or equivalent components, members, and processes illustrated in each drawing are given like reference numerals and a repeated description thereof will be properly omitted. Further, the embodiments are presented by way of example only, and are not intended to limit the present disclosure, and any feature or combination thereof described in the embodiments may not necessarily be essential to the present disclosure.

In the present disclosure, "a state where a member A is connected to a member B" includes a case where the member A and the member B are physically directly connected or even a case where the member A and the member B are indirectly connected through any other member that does not affect an electrical connection state between the members A and B.

Similarly, "a state where a member C is installed between a member A and a member B" includes a case where the member A and the member C or the member B and the member C are indirectly connected through any other member that does not affect an electrical connection state between the members A and C or the members B and C, in addition to a case where the member A and the member C or the member B and the member C are directly connected.

FIG. 1 is a circuit diagram of a backlight device 1 including a control circuit 100 according to an embodiment of the present disclosure. The backlight device 1 is a lighting device that irradiates light to a liquid crystal panel (not shown) from the rear side. The backlight device 1 includes an LED bar for backlight (hereinafter, simply referred to as an "LED bar") 2 and a driving circuit 10 thereof. The backlight device 1 is mounted on an electronic device such as a television, a display device, a notebook PC, a tablet PC or the like.

The LED bar 2 includes a plurality of LEDs connected in series. The driving circuit 10 stabilizes a driving current $I_{LED}$ flowing through the LED bar 2 to a current amount corresponding to a target brightness of the LED bar 2. That is, the driving circuit 10 may be recognized as a constant current circuit.

The driving circuit 10 includes a DC/DC converter 12 and a control circuit 100. The DC/DC converter 12, which is a buck (step-down) converter, receives a DC input voltage $V_{IN}$ by its input line 14 and steps down the received DC input voltage $V_{IN}$ to generate a DC output voltage $V_{OUT}$ on its output line 16. One end (anode) of the LED bar 2 is connected to the input line 14 to receive the input voltage $V_{IN}$, and the other end (cathode) thereof is connected to the output line 16 to receive the output voltage $V_{OUT}$. That is, a difference between the input voltage $V_{OUT}$ and the output voltage $V_{OUT}$ is applied to both ends of the LED bar 2.

The DC/DC converter 12 includes a smoothing capacitor C1, a switching transistor M1, a rectifying diode D1, and a coil (inductor) L1. Since the topology of the DC/DC converter 12 is general, a description thereof will be omitted. A first resistor R1 is a current sensing resistor and is disposed on a path of a current $I_{M1}$ flowing through the switching transistor M1 during an ON period of the switching transistor M1. For example, the first resistor R1 is inserted between a drain of the switching transistor M1 and ground. The switching transistor M1 may be integrated in the control circuit 100. A voltage drop (current sensing signal) $V_{CS}$ proportional to the current $I_{M1}$ is generated in the first resistor R1. The current sensing signal $V_{CS}$ is input to current sensing (CS) terminal of the control circuit 100. As will be described hereinbelow, the current sensing signal $V_{CS}$ is correlated with the driving current $I_{LED}$.

The control circuit 100, which is a functional IC integrated on a single semiconductor substrate, drives the DC/DC converter 12. Specifically, based on the current sensing signal $V_{CS}$, the driving circuit 10 drives the switching transistor Ml so that the driving current $I_{LD}$ flowing through the LED bar 2 approximates a current amount corresponding to the target brightness.

The control circuit 100 includes a pulse signal generating circuit 102 and a driver 104. The pulse signal generating circuit 102 may switch between a quasi-resonant (QR) mode and a continuous current mode (CCM) and generates a pulse signal Sp based on selected mode. The driver 104 switches on/off the switching transistor M1 based on the pulse signal Sp. Specifically, when the, pulse signal Sp has an ON level (e.g., a high level), the driver 104 turns on the switching transistor M1, and when the pulse signal Sp has an OFF level (e.g., a low level), the driver 104 turns off the switching transistor M1.

A microcomputer 4 integrally controls the backlight device 1 or an electronic device on which the backlight device 1 is mounted. That is, the microcomputer 4 has a function of allowing the control circuit 100 to control the brightness of the LED bar 2. For example, the microcomputer 4 generates an analog dimming signal S11 indicating the target value of the driving current $I_{LED}$ (analog dimming) The analog dimming signal S11 may be an analog voltage or a digital signal. The control circuit 100 sets a target level of the current sensing signal $V_{CS}$ based on the analog dimming signal S11.

In addition, the microcomputer 4 controls the brightness by PWM dimming (also referred to as PWM extinction). To this end, the microcomputer 4 generates a PWM dimming signal S12. The PWM dimming signal S12 may be a pulse signal having a first level (e.g., a high level) during a turn--on period of the LED bar 2 and having a second level (e.g., a low level) during a turn-off period thereof. Alternatively, the PWM dimming signal 512 may be an analog voltage indicative of a duty ratio, and the pulse signal generating circuit 1.02 may include a pulse modulator for modulating the PWM dimming signal S12 having an analog voltage into a pulse signal.

Since the brightness of the LED bar 2 is controlled by the microcomputer 4, the microcomputer 4 knows a current amount flowing through the LED bar 2. Here, the mode control of the pulse signal generating circuit 10:2 may be performed by the external microcomputer 4. That is, the microcomputer 4 generates the analog dimming signal S11 and a mode selection signal S13 indicative of a mode, and outputs those signals to the control circuit 100. The pulse signal generating circuit 102 selects a mode corresponding to the mode selection signal S13.

Furthermore, in FIG. 1, the analog dimming signal S11, the PWM dimming signal S12, and the mode selection signal S13 are illustrated to be transmitted on the same signal line. However, the present disclosure is not limited thereto but may be transmitted via individual signal lines or a bus.

Figure 2A:
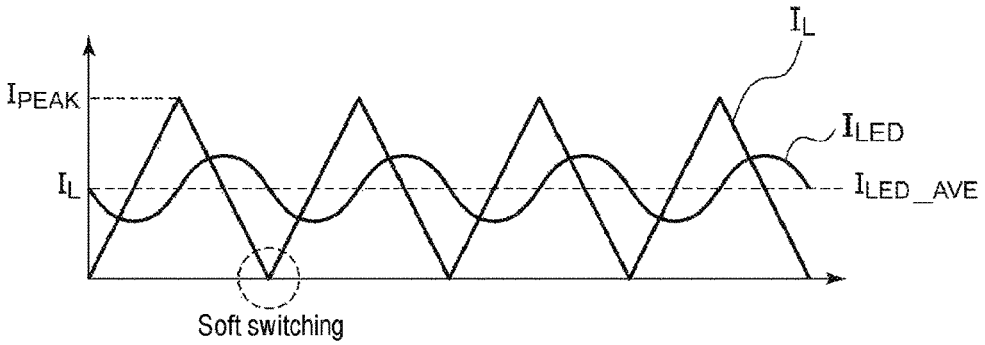
FIGS. 2A and 2B are operational waveform diagrams of a QR mode and a CC mode.
Figure 2B:
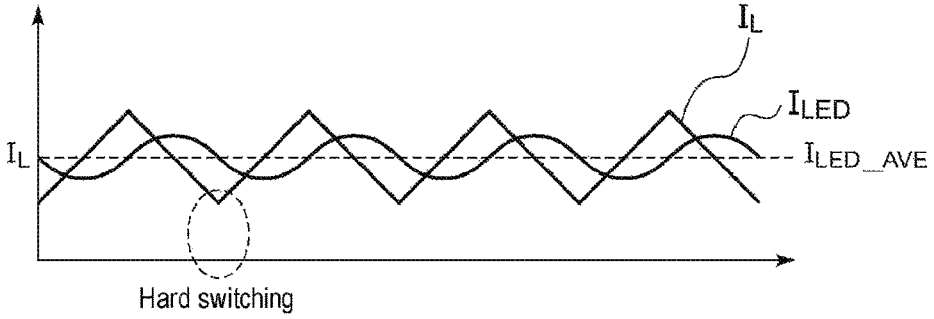

The above is the configuration of the control circuit 100. Next, an operation thereof will be described. FIGS. 2A and 2B are operational waveform diagrams of a QR mode and a CC mode. In the QR mode of FIG. 2A, when the coil current $I_L$ reaches a predetermined peak value, the switching transistor M1 is turned off. Further, when the coil current $I_L$ becomes zero, the switching transistor M1 is turned on again. That is, the turn-on of the switching transistor M1 occurs at a timing when the current is zero (soft switching).

In the CM mode of FIG. 2B, a duty ratio of the pulse signal Sp is adjusted so that a peak value or an average value of the coil current $I_L$ approximates a predetermined target value. The turn-on of the switching transistor M1 occurs, irrespective of a magnitude of the coil current $I_L$ (hard switching).

FIGS. 2A and 2B show the state in which the average currents $I_{LED_AVE}$ of the driving current $I_{LED}$ are equal to each other in order to explain the characteristics of two modes. In the actual operation, however, the QR mode of FIG. 2A is selected when the driving current $I_{LED}$ is relatively large, and the CC mode of FIG. 2B is selected when the driving current $I_{LED}$ is relatively small.

The above is the operation of the control circuit 100. Next, the advantages thereof will be described.

In the QR mode of FIG. 2A, the average value $I_{LED_AVE}$ of the driving current $I_{LED}$ becomes ½ of the peak current $I_{PEAK}$. Thus, in a case where an operation is performed in the QR mode when the driving current $I_{LED}$ is large, the amplitude of the peak current $I_{PEAK}$, namely the coil current $I_L$, increases and the ripple of the driving current $I_{LED}$ also increases. The ripple of the driving current $I_{LED}$ represents fluctuation in the brightness of the LED bar 2. On the other hand, by selecting the CC mode so that the driving current $I_{LED}$ is large, it is possible to lower the peak current $I_{PEAK}$ and even reduce the ripple of the driving current $I_{LED}$.

In addition, since the soft switching is performed in the QR mode, the EMI characteristics are excellent and the heat generation amount of the switching transistor M1 is also reduced. Thus, by selecting the QR mode in the situation in which the driving current $I_{LED}$ is small, these advantages can be obtained. In the QR mode, the ripple becomes relatively large with respect to the same driving current $I_{LED}$ as compared with the CC mode, but, in this embodiment, since the QR mode is selected in the situation in which the driving current $I_{LED}$ is small, the absolute value of the ripple may be small.

For example, the microcomputer 4 may select the QR mode in the situation in which the LED bar 2 emits light with normal brightness as in a 2D mode, and select the CC mode in the situation in which it is required to increase the brightness of the LED bar 2 as in a 3D mode.

The present disclosure extends to various devices and circuits which are recognized by the block diagram or the circuit diagram of FIG. 1 or derived from the aforementioned description, but is not limited to the specific configuration. Hereinafter, more specific configuration examples will be described based on some embodiments in order to help understand and clarify the essence of the present disclosure and a circuit operation thereof, rather than to narrow the scope of the present disclosure.

(First Embodiment)

Figure 3:
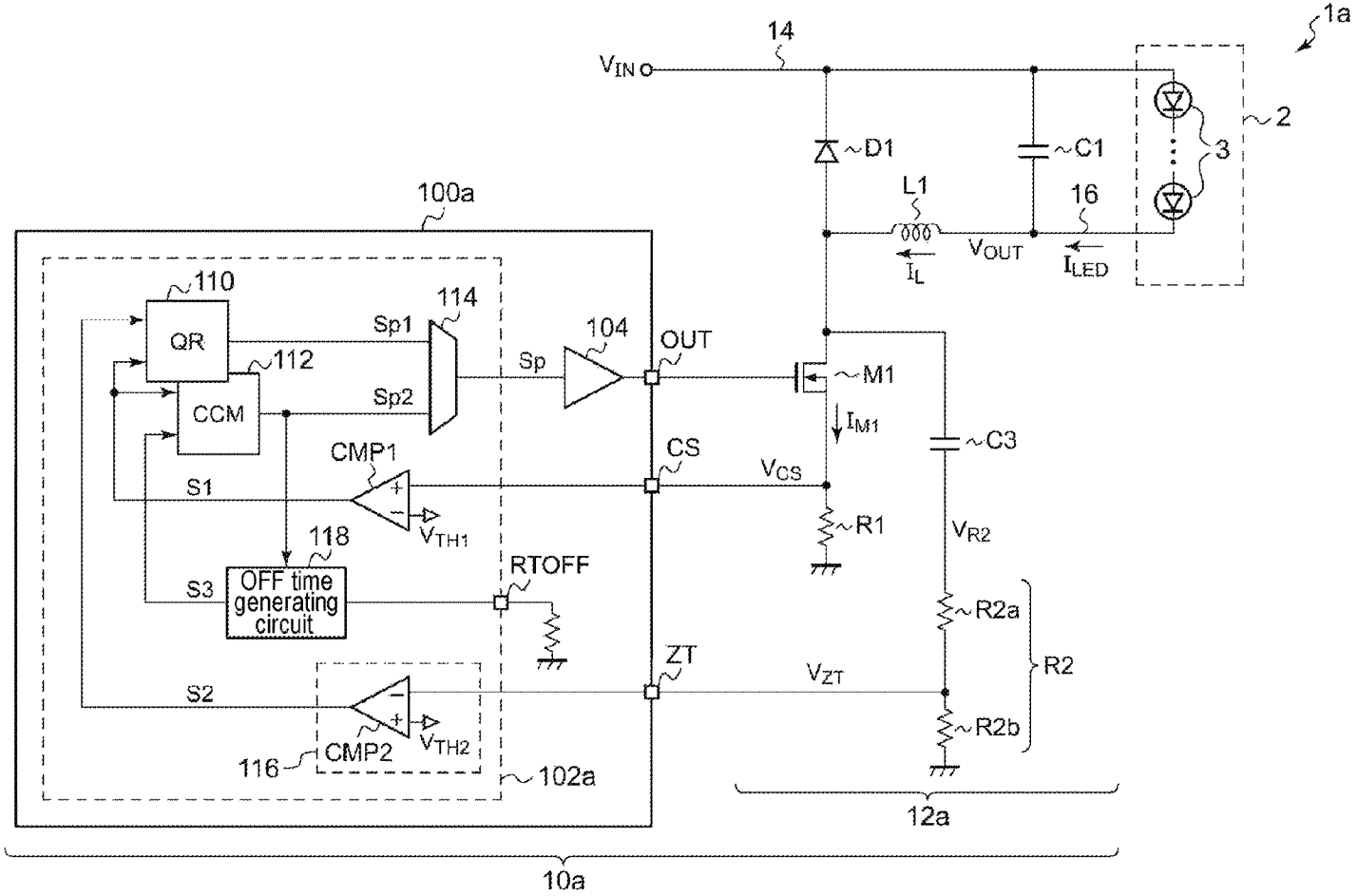
FIG. 3 is a circuit diagram of a backlight device including a control circuit according to a first embodiment.

FIG. 3 is a circuit diagram of a backlight device 1*a* including a control circuit 100*a* according to a first embodiment. A first pulse modulator 110 in a quasi-resonant mode generates a first pulse signal Sp1. A second pulse modulator 112 in a CCM generates a second pulse signal Sp2. A selector 114 selects the first pulse signal Sp1 in the QR mode, and selects the second pulse signal Sp2 in the CCM and outputs the selected pulse signal to the driver 104.

A first comparator CMP1 generates a first signal S1 to be asserted (e.g., having a high level) when the current sensing signal $V_{CS}$ reaches a first threshold value $V_{TH1}$ defining the peak current $I_{PEAK}$. Furthermore, a zero-cross detection circuit 116 generates a second signal S2 to be asserted (e.g., having a high level) when the coil current $I_L$ becomes zero during an OFF period of the switching transistor M1. The first signal S1 and the second signal S2 are input to the first pulse modulator 110.

The first pulse modulator 110 causes the first pulse signal Sp1 to transition to an OFF level in response to the first signal S1 and causes the first pulse signal Sp1 to transition to an ON level in response to the second signal S2. For example, the first pulse modulator 110 may include a sellable and resettable For the zero-cross detection by the zero-cross detection circuit 116, a capacitor C3 and a second resistor R2 are installed in a DC/DC converter 12*a*. The capacitor C3 and the second resistor R2 are installed in series between a connection node of the switching transistor M1 and the coil L1 and ground. A voltage $V_{R2}$ generated in the second resistor R2 is input to a ZT terminal of the control circuit 100*a*. For example, the second resistor R2 includes resistors R2*a* and R2*b*, and a voltage $V_{ZT}$ obtained by dividing the voltage $V_{R2}$ is input to the ZT terminal.

The zero-cross detection circuit 116 includes a second comparator CMP2 for comparing the voltage $V_{ZT}$ of the ZT terminal with a predetermined second threshold value $V_{TH2}$. When the voltage $V_{ZT}$ of the ZT terminal is lower than the threshold voltage $V_{TH2}$, the second comparator CMP2 asserts the second signal S2.

The second pulse modulator 112 of FIG. 3 performs the CC control of an OFF time fixed mode. An OFF time generating circuit 118 asserts a third signal S3 after a predetermined OFF time $T_{OFF}$ has elapsed since the switching transistor M1 has been turned off in the CC mode, namely since the second pulse signal Sp2 has been transitioned to an OFF level. For example, an external resistor R3 is connected to an OFF time setting terminal (RTOFF). The OFF time $T_{OFF}$ may he set based on a resistance value of the resistor R3. For example, the OFF time generating circuit 118 may include a capacitor, a current source for charging the capacitor, and a comparator for comparing a voltage of the capacitor with a threshold value voltage. It may be configured such that a current generated by the current source is adjustable based on the resistor R3.

The third signal S3 is input to the second pulse modulator 112 along with the first signal Si generated by the first comparator CMP1. When the first signal S1 is asserted, the second pulse modulator 112 causes the second pulse signal Sp2 to transition to an OFF level, and when the third signal S3 is asserted, the second pulse modulator 112 causes the second pulse signal Sp2 to transition to an ON level. The second pulse modulator 112 may be configured as a flipflop. In a case where the first pulse modulator 110 and the second pulse modulator 112 are configured with the flipflops, these flipflops may be shared. In this case, the selector 114 may be omitted.

(Second Embodiment)

Figure 4:
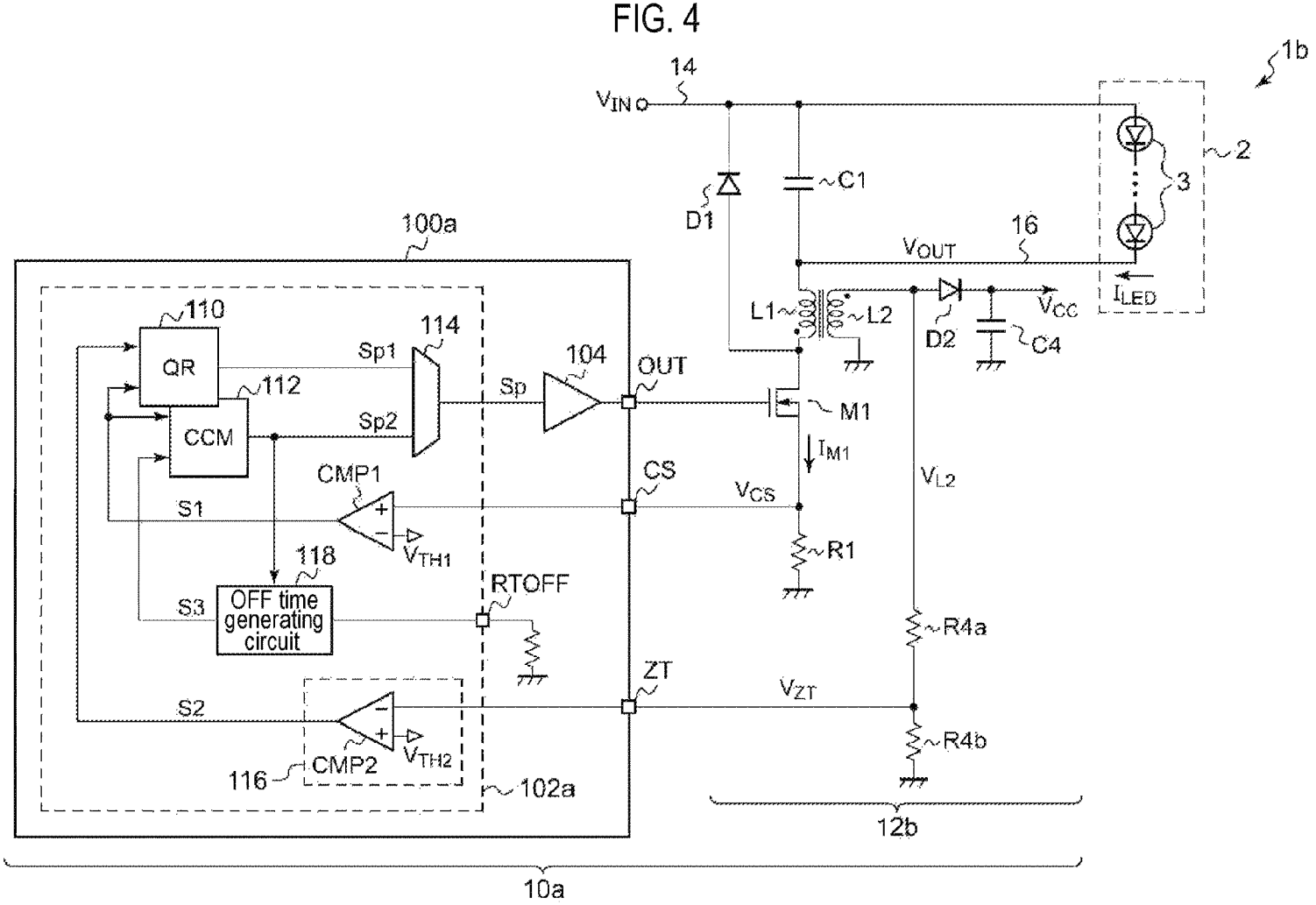
FIG. 4 is a circuit diagram of a backlight device according to a second embodiment.

FIG. 4 is a circuit diagram of a backlight device 1*b* according to a second embodiment. The control circuit 100*a* is similar to that of FIG. 3, but the topology of the DC/DC converter 12*b* is different from that of FIG. 3. In the DC/DC converter 12*b*, the coil L1 is installed between the drain of the switching transistor 141 and the output line 16. The rectifying diode D1 is installed between the input line 14 and the drain of the switching transistor M1.

An auxiliary coil L2 is coupled to the coil L1 with opposite polarity. A voltage $V_{L2}$ generated in the auxiliary coil L2 is input to the ZT terminal of the control circuit 100*a*. For example, the voltage $V_{L2}$ is divided by resistors R4*a* and R4*b* and input to the ZT terminal.

In addition, a rectifying diode D2 and a capacitor C4 are connected to the auxiliary coil L2. A voltage $V_{CC}$ generated in the capacitor C4 may be used as a source voltage of the control circuit 100*a*.

(Third Embodiment)

Figure 5:
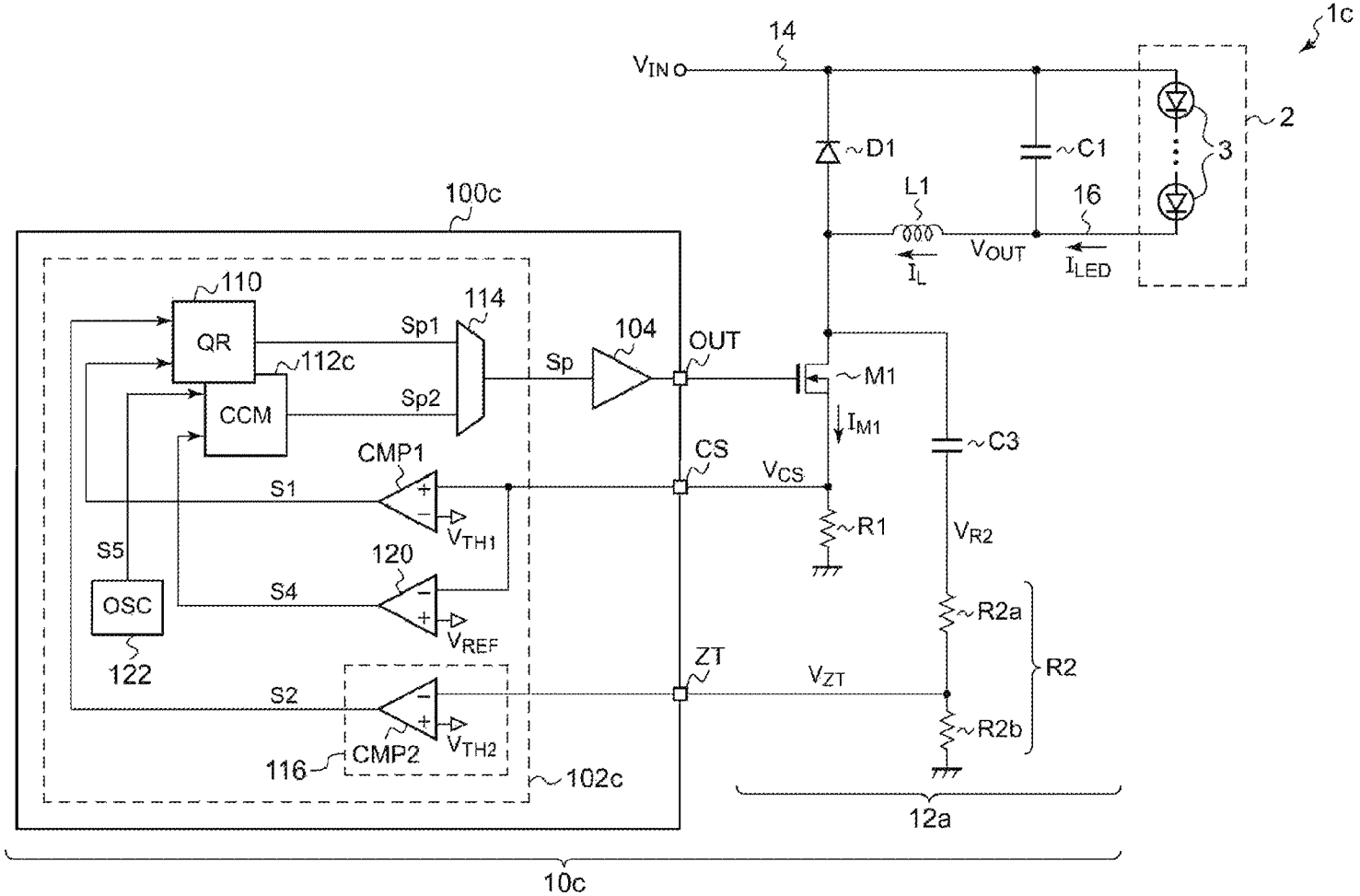
FIG. 5 is a circuit diagram of a backlight device including a control circuit according to a third embodiment.

FIG. 5 is a circuit diagram of a backlight device 1*c* including a control circuit 100*c* according to a third embodiment. A pulse signal generating circuit 102*c* includes an error amplifier 120 and an oscillator 122, instead of the OFF time generating circuit 118 of FIG. 3. A CC mode of a second pulse modulator 112*c* is a frequency fixed PWM mode. The error amplifier 120 amplifies an error between a current sensing circuit $V_{CS}$ of a CS terminal and a reference voltage $V_{REF}$, and generates a fourth signal S4 based on the error. The oscillator 122 generates a fifth signal (periodic signal) S5 having a triangular wave, a sawtooth wave and a ramp waveform of a predetermined frequency. The second pulse modulator 112*c* generates a second pulse signal Sp2 based on a result of a comparison between the fifth signal S5 and the fourth signal S4.

(Fourth Embodiment)

Figure 6:
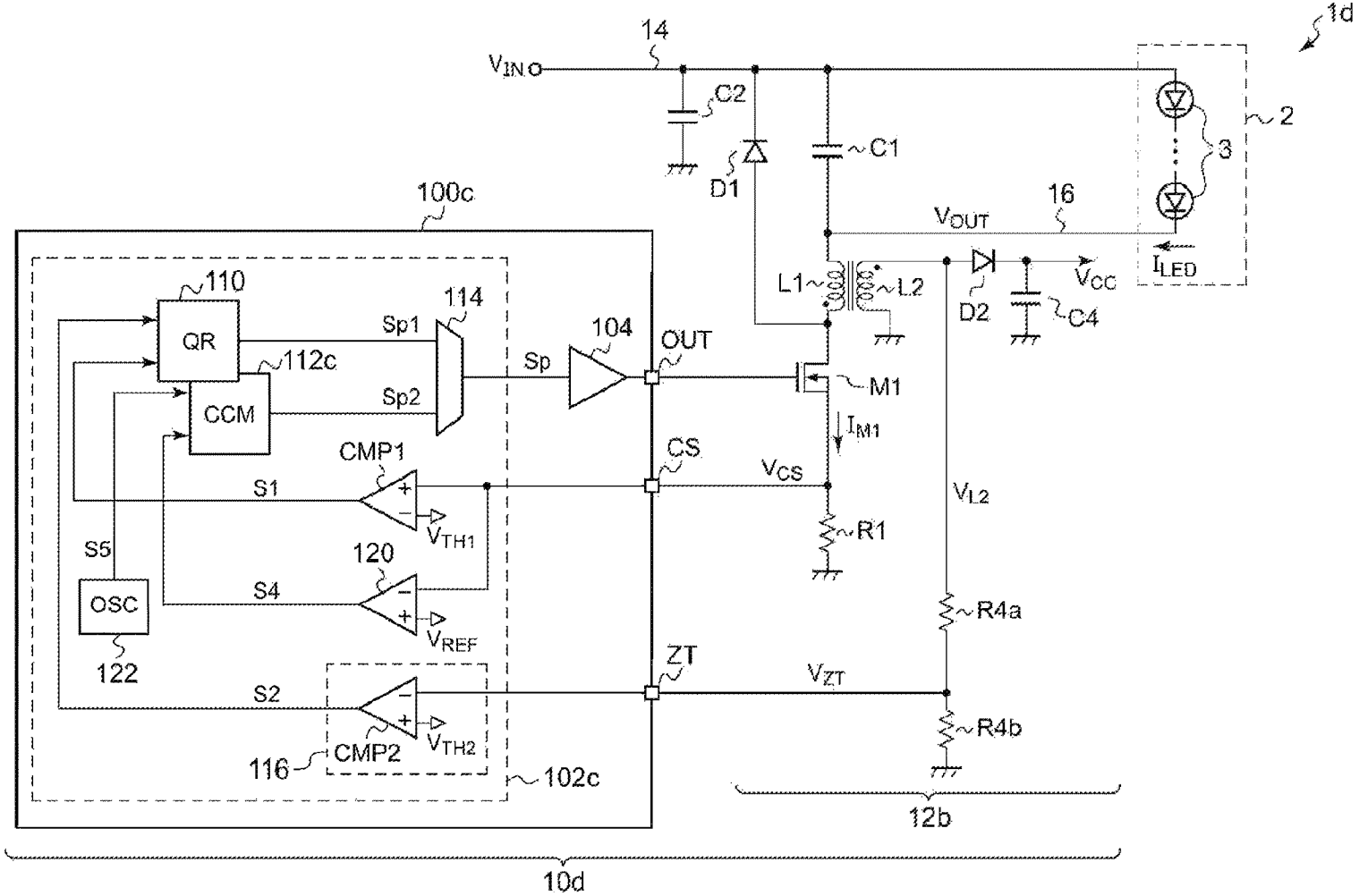
FIG. 6 is a circuit diagram of a backlight device according to a fourth embodiment

FIG. 6 is a circuit diagram of a backlight device 1*d* according to a fourth embodiment. The backlight device 1*d* is a combination of the DC/DC converter 12*b* of FIG. 4 and the control circuit 100*c* of FIG. 5.

Next, mode control will be described.

Figure 7A:
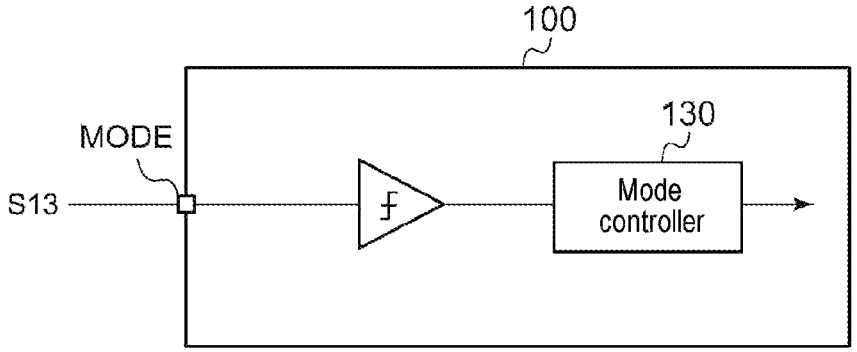
FIGS. 7A to 7C are diagrams illustrating configuration examples regarding a mode control of a control circuit.
Figure 7B:
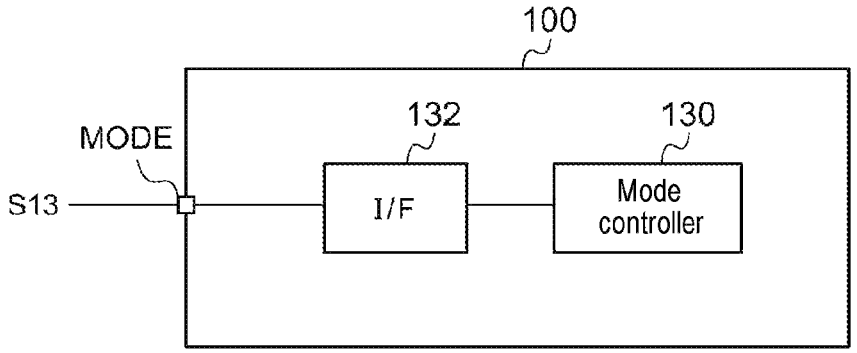
Figure 7C:
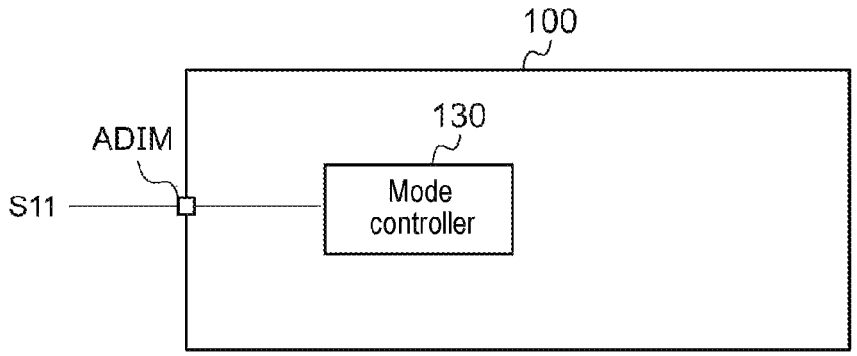

FIGS. 7A to 7C are diagrams illustrating configuration examples regarding the mode control of the control circuit 100. In FIG. 7A, a mode selection signal S13 is input to a mode selection terminal MODE. The mode selection signal S13 is a signal having a binary value of a high level and a low level. A mode controller 130 selects an operation mode of the pulse signal generating circuit 102 in response to the mode selection signal S13. At a front stage of the mode controller 130, a buffer or a comparator may be installed as an interface circuit that receives the mode selection signal S13.

In FIG. 7B, the mode selection signal S13 is input as a serial signal. An interface circuit 132 for receiving the mode selection signal S13 is installed in the control circuit 100. The interface circuit 132 may use an $I^2C$ (Inter Integrated Circuit) interface or a serial peripheral interface (SPI).

In FIG. 7C, an analog dimming signal S11 is input to an analog dimming terminal ADM. The mode controller 130 selects an operation mode of the pulse signal generating circuit 102 based on the analog dimming signal S11. Specifically, the mode controller selects the CC mode when a brightness (driving current LED) represented by the analog diming signal S11 is higher than a predetermined threshold value, and selects the QR mode when the brightness is lower than the predetermined threshold value. The analog dimming signal S11 may be input as a serial signal, and in this case, the interface circuit 132 is added.

Figure 8:
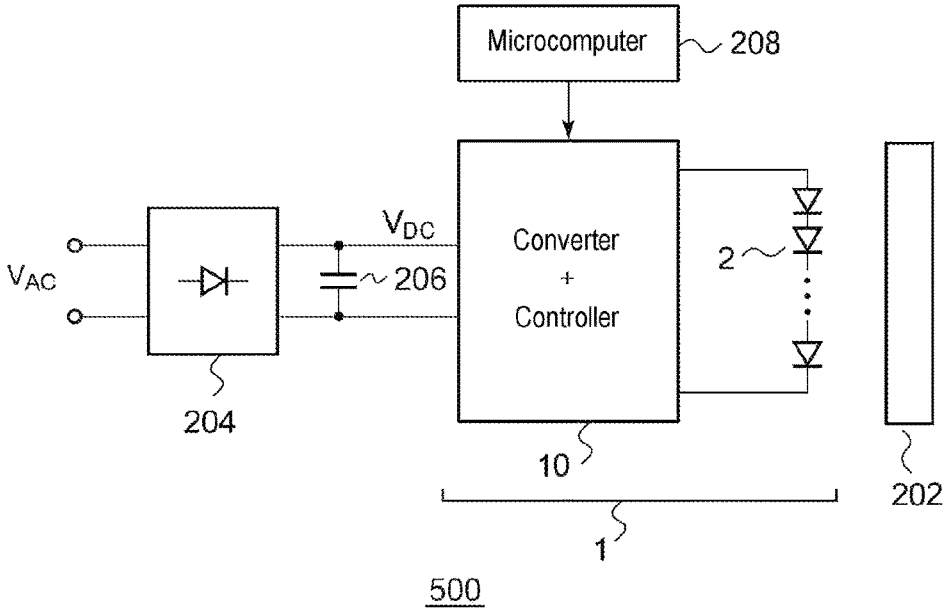
FIG. 8 is block diagram of an electronic device including a backlight device.

FIG. 8 is a block diagram of an electronic device 200 including the backlight device 1 The electronic device 200 includes a liquid crystal panel 202, a rectifying circuit 204, a smoothing condenser 206, and a microcomputer 208, in addition to the backlight device 1. The microcomputer 208 corresponds to the microcomputer 4 of FIG. 1. The backlight device 1 may be a direct type or an edge type. The rectifying circuit 204 and the smoothing condenser 206 may rectify and smoothen a commercial AC voltage $V_{AC}$ and convert the same into a DC voltage $V_{DC}$. The driving circuit 10 steps down the DC voltage $V_{DC}$ generated in the smoothing condenser 206, and supplies the same to the LED bar 2.

It is to be understood by those skilled in the art that the embodiments are merely illustrative and may be differently modified by any combination of the components or processes, and the modifications are also within the scope of the present disclosure. Hereinafter, these modifications will be described.

The control method in the CC mode of the pulse signal generating circuit 102 may be a PWM, OFF time fixed bottom detection, or ON time fixed mode. In this case, an additional comparator for comparing the current sensing signal $V_{CS}$ of the CS terminal with a threshold value defining the bottom of the coil current $I_L$ may be installed in FIG. 4. Furthermore, the OFF time generating circuit 118 may be configured as an ON time generating circuit.

In the embodiments, the non-insulating DC/DC converter 12 has been described, but a forward type or a feedback type insulating converter may be used.

According to some embodiments of the present disclosure, it is possible to obtain good characteristics within an extensive output current range.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A control circuit of a driving circuit for a backlight LED, the driving circuit including a DC/DC converter that supplies a driving current to the backlight LED, the control circuit comprising:

a pulse signal generating circuit configured to:

receive, from an external microcomputer, a control signal for controlling a target brightness of the backlight LED;

generate a pulse signal based on a mode that is selected from a quasi-resonant mode and a continuous current mode; and switch between the quasi-resonant mode and the continuous current mode based on the control signal from the external microcomputer; and a driver configured to drive the DC/DC converter based on the pulse signal.

2. The control circuit of claim 1, wherein the pulse signal generating circuit comprises:

a first pulse modulator of the quasi-resonant mode configured to generate a first pulse signal; and a second pulse modulator of the continuous current mode configured to generate a second pulse signal.

3. The control circuit of claim 2, wherein the pulse signal generating circuit further comprises a selector configured to select one of the first pulse signal and the second pulse signal based on the control signal and output a selected pulse signal to the driver.

4. The control circuit of claim 2, wherein the DC/DC converter comprises:

a switching transistor;

a coil;

a rectifying device; and a first resistor disposed on a path of a current flowing through the switching transistor during an ON period of the switching transistor.

5. The control circuit of claim 4, wherein the pulse signal generating circuit further comprises:

a first comparator configured to generate a first signal to be asserted when a current sensing signal indicative of a voltage drop of the first resistor reaches a first threshold value; and a zero-cross detection circuit configured to generate a second signal to be asserted when a current flowing through the coil becomes zero during an OFF period of the switching transistor, wherein the first pulse modulator is configured to cause the first pulse signal to transition to an OFF level in response to the first signal and to cause the first pulse signal to transition to an ON level in response to the second signal.

6. The control circuit of claim 5, further comprising a zero-cross detection terminal, wherein the zero-cross detection circuit comprises a second comparator configured to compare a voltage of the zero-cross detection terminal with a predetermined second threshold value to generate the second signal based on a comparison result.

7. The control circuit of claim 6, wherein the DC/DC converter further comprises:

a capacitor and a second resistor installed in series between a connection point of the switching transistor and the coil and a ground, wherein a voltage of the second resistor is input to the zero-cross detection terminal.

8. The control circuit of claim 6, wherein the DC/DC converter further comprises an auxiliary coil coupled to the coil, and wherein a voltage of the auxiliary coil is input to the zero-cross detection terminal.

9. The control circuit of claim 5, wherein the pulse signal generating circuit further comprises:

an OFF time generating circuit configured to generate a third signal to be asserted when a predetermined OFF time has elapsed since the second pulse signal has been transitioned to an OFF level, wherein the second pulse modulator is configured to cause the second pulse signal to transition to an OFF level when the first signal is asserted and to cause the second pulse signal to transition to an ON level when the third signal is asserted.

10. The control circuit of claim 9, wherein the OFF time generating circuit is grounded via an external resistor, and wherein the predetermined OFF time is set based on a resistance value of the external resistor.

11. The control circuit of claim 4, wherein the pulse signal generating circuit further comprises:

an error amplifier configured to amplify an error between a current sensing signal indicative of a voltage drop of the first resistor and a predetermined reference voltage to generate a fourth signal, wherein the second pulse modulator is configured to generate the second pulse signal based on a result of comparison between the fourth signal and a periodic signal having a predetermined frequency.

12. The control circuit of claim 1, wherein the continuous current mode is an OFF time fixed mode.

13. The control circuit of claim 1, wherein the continuous current mode is a frequency fixed PWM mode.

14. The control circuit of claim 1, further comprising an interface circuit configured to receive the control signal, wherein the control signal has a binary value of a high level or a low level, and wherein the pulse signal generating circuit is configured to select the mode corresponding to the control signal.

15. The control circuit of claim 1, wherein the control signal is an analog dimming signal indicative of a current amount of the backlight LED, and the pulse signal generating circuit is configured to select the mode based on the analog dimming signal.

16. The control circuit of claim 15, wherein the pulse signal generating circuit is configured to select the continuous current mode when the target brightness of the backlight LED represented by the analog dimming signal is higher than a predetermined threshold value, and select the quasi-resonant mode when the target brightness is lower than the predetermined threshold value.

17. The control circuit of claim 1, wherein the control circuit is integrated on a single semiconductor substrate.

18. A driving circuit, comprising:

a DC/DC converter configured to supply a driving current to a backlight LED; and the control circuit of claim 1, configured to control the DC/DC converter.

19. An electronic device, comprising;

a liquid crystal panel;

a backlight including an LED and configured to irradiate light to the liquid crystal panel from a rear side; and the driving circuit of claim 18, configured to drive the LED.

20. The control circuit of claim 1, wherein the control signal depends on a target value of the driving current that corresponds to the target brightness of the backlight LED.

* * * * *